United States Patent [19]

Rohr et al.

[11] 4,151,787

[45] May 1, 1979

[54] MULTIPLE FOLDED PLASTIC BAG METHOD

[75] Inventors: Thomas D. Rohr, Wayne; Charles E. Van Ness; Robert W. Wolfe, both of Mountain Lakes, all of N.J.

[73] Assignee: Union Carbide Corporation, New York, N.Y.

[21] Appl. No.: 829,926

[22] Filed: Sep. 1, 1977

[51] Int. Cl.[2] ..... B31B 1/00

[52] U.S. Cl. ..... 93/32; 93/13; 93/33 H; 93/84 R; 206/494

[58] Field of Search ..... 93/32, 33 H, 20, 13, 93/84 R, 86; 206/494, 526, 554

[56] References Cited

U.S. PATENT DOCUMENTS

| | | | |
|---|---|---|---|
| 3,599,538 | 8/1971 | Piazze | 93/33 H |
| 3,779,139 | 12/1973 | White | 93/33 H X |
| 3,826,361 | 7/1974 | Heckrodt | 206/494 X |
| 4,010,299 | 3/1977 | Hershey et al. | 206/494 X |

FOREIGN PATENT DOCUMENTS

| | | | |
|---|---|---|---|
| 606007 | 11/1934 | Fed. Rep. of Germany | 206/494 |
| 2356126 | 5/1975 | Fed. Rep. of Germany | 93/32 |

*Primary Examiner*—Leon Gilden
*Attorney, Agent, or Firm*—Eugene Lieberstein

[57] ABSTRACT

A "U" folded side-welded bag having a multiplicity of folds for packaging within a carton with the open top end of the bag terminating at the outermost fold, formed by introducing an off-center fold transverse to the longitudinal axis of the bag and winding the bag into a roll starting from such off-center fold line. Thereafter, the rolled bag is flattened and folded into a final "U" fold form. A number of such folded bags are stacked in a carton having an access opening with the top end of each bag aligned with the access opening.

9 Claims, 11 Drawing Figures

MULTIPLE FOLDED PLASTIC BAG METHOD

The present invention relates to packaging arrangements for plastic bags, and more particularly to a method of making multiple folds in a plastic bag, to a folded plastic bag, and to a dispensing carton containing a plurality of such multiple folded bags.

Plastic bags are available in varying sizes for many diverse applications. The larger size bags are commonly folded over a number of times into flat articles of an appropriate size corresponding to the size of a dispensing carton into which a predetermined number are packaged. These bags are made from film material composed from various plastic polymers such as, for example, polyethylene, polyvinyl chloride and polyesters. The material is formed into a very thin film which has substantially no structural rigidity and low surface friction. Consequently, once the plastic film is processed into individual bags the front and back face cling to each other, thereby rendering it difficult for the user to distinguish the open end from the closed end or from either side edge. Locating the open end is even more cumbersome for the aforementioned larger size bags which are presently folded in a manner, following conventional folding procedures, which confines the open end of each bag to one of the interior folds. In addition conventional packaging of individually folded bags leaves the bag orientation within the dispensing carton to chance. Present day attempts to alleviate the frustration of the user in grasping only one bag from the carton and readily finding the open end have been directed to the use of a two-ply, two-color bag in which the interior and exterior are distinguished by different colors.

Accordingly, it is the principal object of the present invention to provide a method for making multiple folds in a plastic bag such that the outermost fold terminates at the open top of the bag and the bottom of the bag is confined to one of the interior folds.

It is another object of the present invention to provide a folded bag whereby the user of the folded bag may find the open top of the bag before unfolding it.

It is yet another object of the present invention to provide a carton of individually folded plastic bags arranged for one at a time dispensing, with each bag having a multiplicity of folds oriented to expose the open top in alignment with the access opening in the carton.

The foregoing and other objects and advantages of the present invention will become more fully apparent from the following description when read in conjunction with the accompanying drawings in which.

Figure 1:
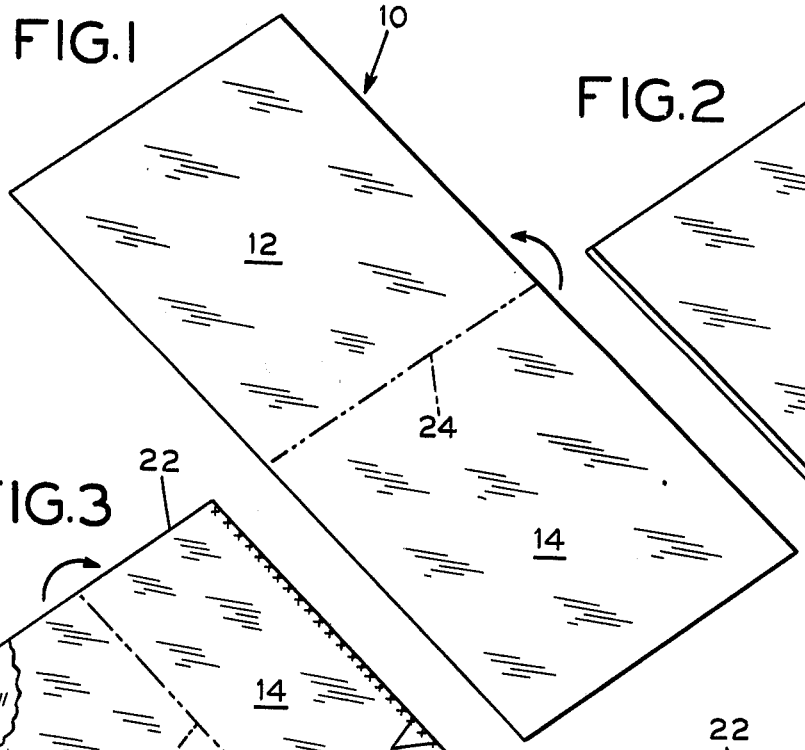
FIG. 1 is a perspective view of a sheet of plastic film material from which the folded bag of the present invention is formed.
Figure 2:
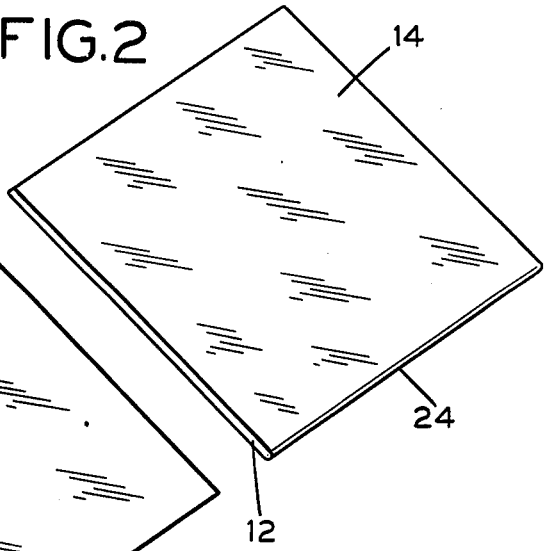
FIGS. 2 and 3 illustrate in perspective the sequence in the formation of a typical side seamed "U" folded bag.
Figure 3:
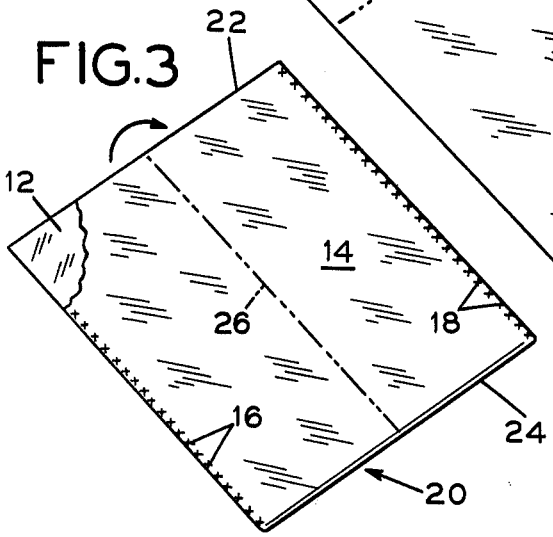

The sheet of plastic material 10 shown in FIG. 1 may be processed into a bag of any desired configuration using conventional manufacturing procedures. A bag which is preferred for its simplicity of manufacture and strength is the side seam welded "U" folded bag having a seamless bottom. Such a bag may be made by doubling over the sheet of plastic material 10 upon itself into a "U" configuration for forming two equal panels 12 and 14 as indicated in FIG. 2. The overlapping edges may then be heat sealed together to form a pair of parallel side seams 16 and 18 respectively. Alternatively, the bag may be made by side welding "U" folded film from rolled stock. This simple procedure produces a bag 20 as is shown in FIG. 3 having an open top 22 and a closed bottom 24 with the side welded seams 16 and 18 extending lengthwise from the bottom 24 to the top 22. The side welds are preferably formed using a heating element as is well known in the art. Although a side welded bag configuration is preferred, the present invention is not limited thereto. Moreover, although no specific equipment has been shown for automatically forming the bag 20, apparatus is available commercially for forming a bag as indicated starting either from a roll of plastic film or from sheet stock.

Once the bag 20 is formed, it is folded off-center and rolled before packaging into a carton as will be hereinafter explained in accordance with the sequence illustrated in FIGS. 4 through 10 inclusive.

Figure 4:
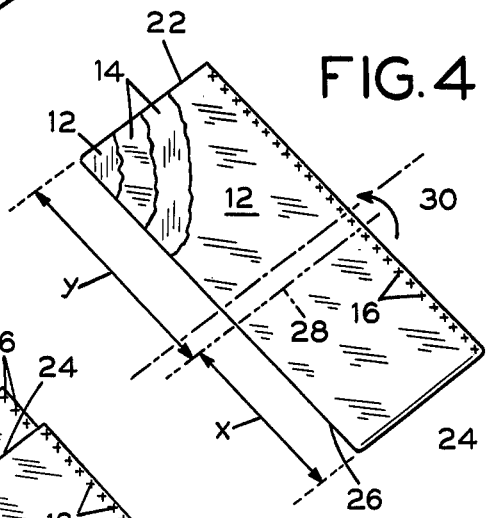
FIGS. 4 through 7 illustrate in perspective the sequence of folding the bag of FIG. 3 in accordance with the present invention.
Figure 5:
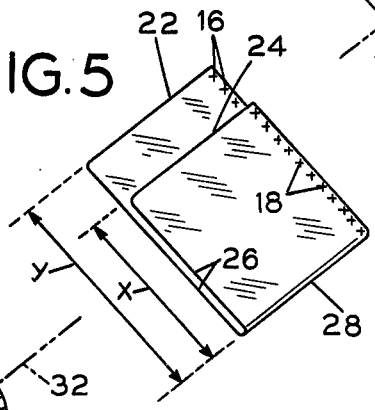

The bag 20 of FIG. 3 may initially be folded at least once over its longitudinal axis 26 with the side seams 16 and 18 superimposed in a substantially overlapping relationship. Although a longitudinal fold is desirable, it is not essential that it be formed in the first folding operation. The bag 20 must, however, be folded as shown in FIGS. 4 and 5 to establish a fold line 28 spaced apart from the center of the bag such that the distance from the closed bottom 24 to said fold line 28, marked "X", is substantially smaller than the distance marked "Y" from the fold line 28 to the open top end 22. The fold line 28 should preferably be formed so that it lies parallel to the transverse axis 30 passing through the center of the bag 20. The off-center fold line 28 is critical to the folding operation of the present invention.

Figure 7:
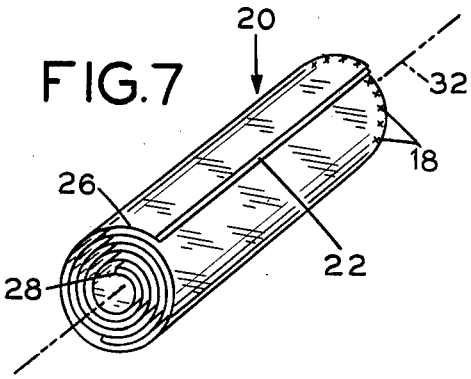
Figure 6:
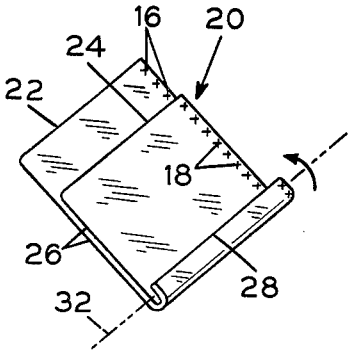

After the bag 20 is folded off-center as shown in FIG. 5, the bag 20 is rolled as shown in FIGS. 6 and 7 about a roll axis 32 using the fold line 28 as the leading edge in the rolling operation. Although the rolling of the bag 20 may be performed manually it is preferable that it be done by machine. The folding operation may be carried out with or without the use of a mandrel. A typical machine that may be used for performing a coreless rolling operation is shown and described in U.S. Pat. No. 3,671,033, the disclosure of which is herein incorporated by reference. The off-center folded bag 20 is intended to be advanced, preferably by conveyor, with the fold line 28 introduced as the leading edge thereof into the machine described in the aforementioned patent. The rolling apparatus of such machine includes, in general, a plurality of intermeshing drive rollers which are arranged in a substantially circular pattern to define a generally circular moving surface which drives the bag around in a roll.

The rolled bag 20, shown in perspective in FIG. 7, will automatically terminate with the open top 22 on the outer surface of the roll and with the bag bottom 24 within the roll, provided the off-center fold line 28 was formed with a sufficient off-center spacing "Y-X" and provided further that the rolling operation proceeded from the fold line 28 as the leading edge thereof. By following this procedure the termination of the open top 22 at the outermost surface will be independent of the number of roll revolutions and the bag length. However, the latter parameters will determine the end location of the open top about the outer periphery of the rolled bag 20.

Figure 8:
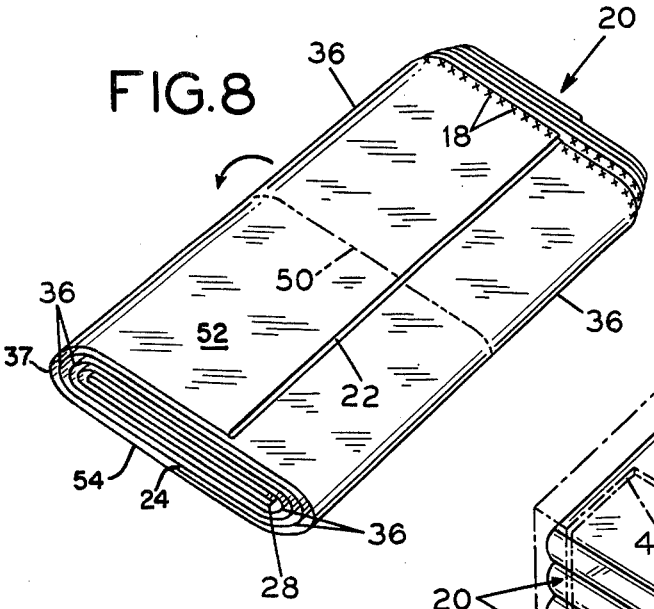
FIG. 8 shows the folded bag of FIG. 7 flattened to form additional folds.
Figure 10:
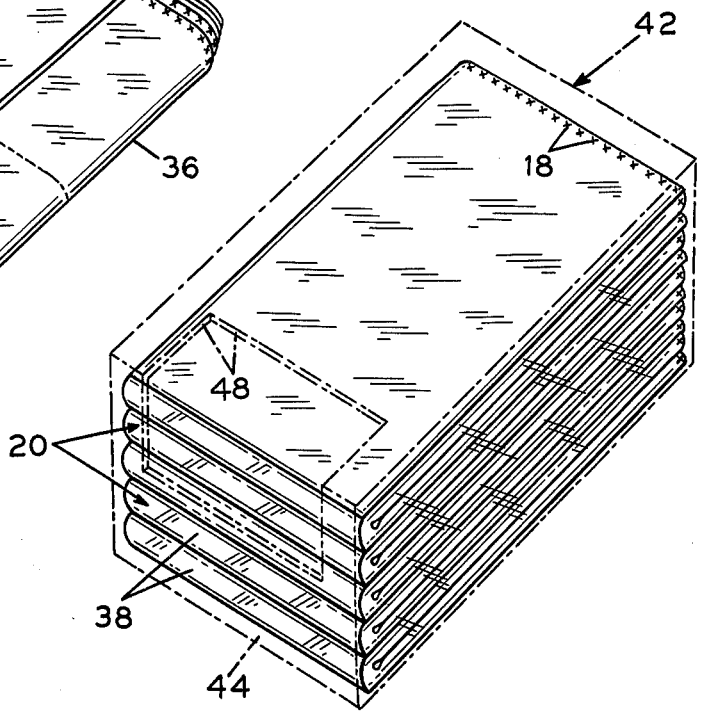
FIG. 10 shows a plurality of multiple folded bags stacked within a dispensing carton with each bag oriented with the open end thereof in alignment with the access opening of the carton.

The rolled bag 20 is thereafter flattened to form many additional fold lines 36 which lie substantially transverse to the longitudinal axis 26. The flattened bag 20 is shown in FIG. 8. It includes a top planar surface 52 and a bottom planar surface 54. As indicated above, the bag 20 is rolled from the off-center fold 28 which fold constitutes a single transverse fold of the flattened bag. The remaining transverse folds 36, resulting from flattening the rolled bag, are pairs of folds with each fold of a pair at an equal distance from the off-center fold but spaced in opposite directions from the off-center fold. The last outermost fold 37 is a single fold since the bottom end of the bag 24 terminates beneath the bottom planar surface 54, as shown in FIG. 8. The mouth end of the bag 22 terminates on the top planar surface 52. This constitutes the configuration of the bag after rolling and flattening if the off-center spacing "Y-X" is substantial. If the off-center spacing "Y-X" is minimal, the mouth end of the bag 22 and the bottom end of the bag 24 may terminate on the same planar surface, but the mouth 22 of the bag will always be exposed on the surface and the bottom 24 will always be hidden by the outermost layer of the plastic.

Figure 9:
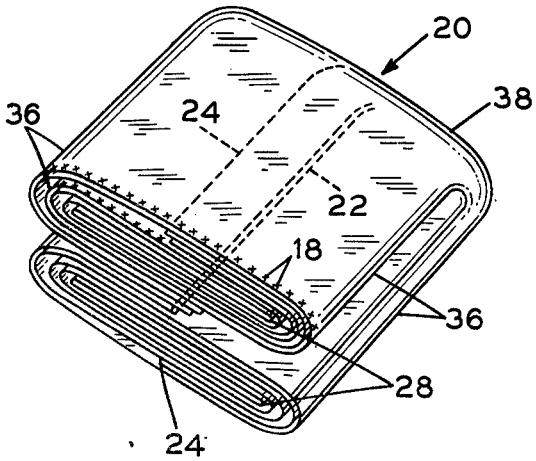
FIG. 9 shows the flattened bag of FIG. 8 folded over upon itself in position for packaging within a carton.
Figure 11:
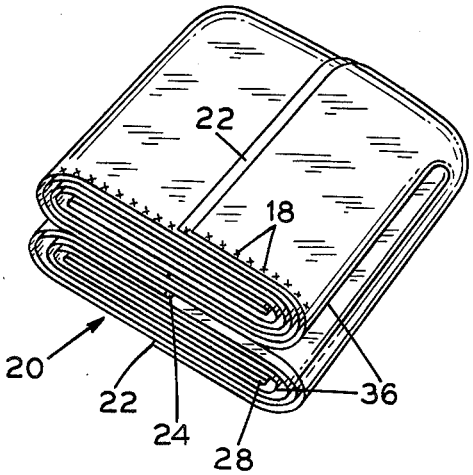
FIG. 11 shows an alternate folding arrangement for the flattened bag of FIG. 8.

If the bag 20 is sufficiently narrow, no further folding is necessary for packaging. However, for wider bags, as is normally the case, it is preferred to introduce an additional final "U" fold about axis 50 before insertion within a carton. Fig. 9 shows the flattened bag of FIG. 8 folded over the axis 50 so as to form a smooth rounded fold 38 with the open top 22 of the bag 20 hidden from direct view. A plurality of such bags are then placed into a carton 40 having a top surface 42, a bottom surface hidden from view, two side surfaces and two end surfaces 44 and 46 respectively. An access opening 48 is provided at one end of the carton 40 extending from the end face 44 to the top surface 42. The access opening 48 permits the removal of a bag by its rounded end 38. The open top of the bag 22, although hidden, is in alignment with the access opening 48 and oriented in a plane passing substantially through the center of the opening 48. Accordingly, upon removal of a bag the user need only open up the outermost fold 38 of the bag of FIG. 9 to find the bag mouth 22. Conversely, the bag 20 may have the final "U" fold formed with the open top 22 exposed as shown in FIG. 11. Packing the bags 20, folded as in FIG. 11, in the carton 40 with the open top in alignment with the access opening 48 would provide immediate access to the open mouth 22 of each bag 20.

In light of the foregoing disclosure, alternative modes of practicing the present invention will undoubtedly suggest themselves to those skilled in the art. For example, longitudinal fold line 26 is shown centrally located in FIG. 3, but fold line 26 need not be located at the central axis of the bag and it can be located at a longitudinal axis which is closer to one side edge of the bag than the other. Similarly, axis 50 in FIG. 8 is shown centrally located but axis 50 need not be centrally located. It is thus intended that the foregoing disclosure be taken as illustrative only, and that it not be construed in any limiting sense.

We claim:

1. A method for making multiple folds in a plastic bag having an open top end and a closed bottom end such that the open top of the bag terminates at the outermost fold, comprising the steps of:

(a) folding said bag to form a fold line in a direction transverse to the longitudinal axis of said bag and spaced from the center of the bag such that the distance from the bottom end of the bag to said fold line is less than the distance from said fold line to the open top end of the bag;

(b) rolling the folded bag from said off-center fold line about a roll axis lying substantially parallel to said fold line; and (c) flattening said rolled bag to form a plurality of additional folds each lying substantially parallel to said fold line.

2. A method as defined in claim 1 wherein the bottom end of the bag is a folded end and wherein said plastic bag has parallel side welded seams extending longitudinally from said bottom end to said open top end.

3. A method as defined in claim 2 further comprising the step of longitudinally folding said bag prior to step (a) to form at least one first fold line along a longitudinal axis of said bag.

4. A method as defined in claim 3 wherein said first fold line is formed with the side welded seams substantially superimposed.

5. A method as defined in claim 4 further comprising the step of folding said flattened bag subsequent to step (c) about an axis of said flattened bag.

6. A method as defined in claim 1 further comprising the step of longitudinally folding said bag prior to step (a) to form at least one first fold line along a longitudinal axis of said bag.

7. A method as defined in claim 6 wherein said bag has two side edges and said first fold line is formed with the side edges substantially superimposed.

8. A method as defined in claim 7 further comprising the step of folding said flattened bag subsequent to step (c) about an axis of said flattened bag.

9. A method as defined in claim 1 further comprising the step of folding said flattened bag subsequent to step (c) about an axis of said flattened bag.

* * * * *